United States Patent [19]

Menge

[11] 3,991,480

[45] Nov. 16, 1976

[54] METHOD OF AND APPARATUS FOR THE DRYING OF ODORIFEROUS ORGANIC SUBSTANCES

[75] Inventor: Wilhelm Menge, Isernhagen FB, Germany

[73] Assignee: Sudoldenberger Tierfrischmehl-Anlagen GmbH & Co., KG, Nordlohne, Germany

[22] Filed: May 27, 1975

[21] Appl. No.: 580,941

[30] Foreign Application Priority Data

May 25, 1974 Germany ..... 2425445
Apr. 21, 1975 Germany ..... 2517527

[52] U.S. Cl. ..... 34/10; 34/28; 34/79; 34/57 R; 261/7; 261/16; 261/29; 261/98

[51] Int. Cl.[2] ..... F26B 3/10

[58] Field of Search ..... 34/10, 57 R, 57 A, 26, 34/28, 32, 33, 72, 79; 55/228, 233, 90, 94; 261/7, 16, 94, 95, 98, 29

[56] References Cited

UNITED STATES PATENTS

| | | | |
|---|---|---|---|
| 3,028,295 | 4/1962 | Trobeck et al. | 261/16 |
| 3,212,197 | 10/1965 | Crawfod | 34/10 |
| 3,227,701 | 1/1906 | Pennington | 261/16 |
| 3,336,733 | 8/1967 | Wisting | 55/228 |
| 3,354,555 | 11/1967 | Barr | 34/57 R |
| 3,518,772 | 7/1970 | Barr | 34/10 |
| 3,699,662 | 10/1972 | Stephanoff | 34/10 |
| 3,802,089 | 4/1974 | Stephanoff | 34/10 |
| 3,879,856 | 4/1975 | Barr | 34/10 |
| 3,885,929 | 5/1975 | Lyon et al. | 55/94 |

*Primary Examiner*—John J. Camby
*Assistant Examiner*—Larry I. Schwartz
*Attorney, Agent, or Firm*—Wigman & Cohen

[57] ABSTRACT

A method of and apparatus for drying odoriferous organic substances wherein the substances are introduced into a ring-shaped piping system via a turbulence mechanism in which the substances are comminuted and thereafter circulated through the piping system and dried by a heated air flow produced by a heater and a blower. Air flow containing the dried substances is discharged from the piping system and passed over a separation system where the dried substances are separated from the humid odoriferous air flow. The air flow withdrawn from the piping system is introduced into a sprinkling bed where a chemical reaction takes place to deodorize the air flow.

28 Claims, 3 Drawing Figures

METHOD OF AND APPARATUS FOR THE DRYING OF ODORIFEROUS ORGANIC SUBSTANCES

BACKGROUND OF THE INVENTION

This invention relates to a method of and apparatus for drying odoriferous substances.

Organic substances are obtained in many plants in a more or less humid state and in different sizes, for instance, as feces, feathers, hairs, remains from slaughtering, carcasses etc. Their processing for utilization in a dry state, for instance, for fertilizing purposes, meets with great difficulties due to the odors which develop during the drying process. It is known to remove the odors from the released gases by adding certain chemicals and by using spraying equipment. However, the drying of great quantities of organic substances has not yet been satisfactorily solved.

OBJECTS AND SUMMARY OF THE INVENTION

It is, therefore, an object of the present invention to provide a method and apparatus by which greater quantities of organic substances can be continuously dried without having the odoriferous substances released into the atmosphere. By the present invention the humid substances are introduced into a ring-shaped piping system having a turbulence mechanism. A circulating air flow is produced by means of a blower having a suction effect on the piping system and the humid substances are suspended in the air flow until their content of humidity is sufficiently reduced. If necessary, the particle size is sufficiently decreased and the air flow containing the dried substances is discharged from the ring-shaped piping system through a separation plant to a sprinkling bed where the odoriferous substances which remain in the air flow are converted into deodorized substances.

During the performance of the first stage of the method in the ring-shaped piping system in accordance with the invention, an air velocity of 10 to 22 meters per second is maintained. With this air velocity only the dried particles of a desired particle size are carried along while larger particles with the corresponding high humidity content fall back again to the turbulence mechanism designed as a hammer mill or as a beater mill, in order to be further crushed. In this first system, an air temperature of 280° C to 320° C and, preferably, about 300° C is maintained. A drying period of from about 1 to 3 seconds and a circulation period of from about 1 to 3 seconds is also generally employed in the ring-shaped piping system.

Thus, an object of the invention is to provide a method for drying odoriferous organic particles wherein the substances to be dried are introduced into a ring-shaped piping system having a turbulence mechanism and an air flow circulating in the system at a velocity of about 10 to 22 meters per second at an air temperature of about 280° C to 320° C for a circulation period of from about 1 to 3 seconds and wherein the air flow containing the dried substances is discharged from the ring-shaped piping system and is directed over a separation plant to a sprinkling bed for a reaction period of from 1 to 9 seconds.

In accordance with a preferred embodiment of the method of the invention, an air velocity of from 15 to 20 meters per second and a reaction period of from about 2 to 7 seconds, in particular 5.5 to 6.5 seconds, is employed. In the deodorization system, a rising velocity of the air mixture to be deodorized of about 0.5 to 1.5 meters per second is employed. For deodorization, there is employed a liquid solution containing alkaline earth carbonate, preferably a solution containing a calcium and/or magnesium carbonate. Particularly good results are obtained using a suspension comprising 1 part calcium and/or magnesium carbonate having from about 5 to 30 parts water.

A further object of the invention is to provide an apparatus for performing the above described method, which apparatus comprises broadly a drying system, a separation system and a deodorization system. More particularly, the drying system includes a piping system having a turbulence mechanism above which is arranged a rising tube which is connected to a separation system via a wide arcuate elbow. The separation system operates on a certrifugal basis and the portion of the separation system which collects the suspended, not yet separated substances is reintroduced through a tube to the turbulence mechanism. In the center of the separation system there is an opening for receiving the substances to be separated to which opening is connected a discharge tube communicating with a suction blower. The discharge tube is arranged over the funnels of cyclone separator units and is provided with openings arranged in such a way that the substances suspended in the withdrawn air flow descend into the funnels. A dust washer is provided at the inlet of the suction blower and the outlet thereof is connected to a sprinkling bed tower in such a way that the withdrawn air containing odoriferous substances is forced into the tower.

In accordance with a preferred embodiment of the apparatus of the present invention, the turbulence mechanism comprises a hammer mill or a beater mill and the angle of the inclined tubes of the drying system in relation to the rising tube is between about 10° and 40°. The outlet of the suction blower is preferably connected with the inlet of a second blower, the outlet of the second blower being connected to the sprinkling bed tower. Further, the inlet or suction opening of the second blower is also connected to an exhaust air piping system which draws exhaust air from the space surrounding the ring-shaped piping system. It is also preferred that the air flow be produced or reinforced by a blower which forces hot air of a temperature of about 280° C to 320° C into the ring-shaped piping system.

Still another object of the present invention is to provide apparatus which forms part of the total system to deodorize released gases. Such apparatus comprises a tower with a jacket having at its upper portion a spraying device and a turbulence stage and, at its lower portion, a device for charging the released gases mixed with chlorine or $SO_2$ characterized in that the tower has one or several turbulence stages whereby the spraying devices are arranged in accordance with the number of the turbulence stages and a re-mixing zone is provided at the lower portion of the tower.

In accordance with a preferred embodiment of the deodorizing apparatus of the invention, a cone is arranged below the tower drain whereby the point of the cone is aligned with the center of the tower diameter and air or pressure water nozzles, respectively, are arranged in the jacket. In another embodiment of the deodorizing apparatus, a conical cavity is advantageously arranged below the tower drain under which drain there is located an agitator. Both the aforesaid embodiments of the deodorizing apparatus are provided with an overflow and an intake conduit, the overflow conduit being connected to one or more settling tanks in order to minimize the use of water and avoid environmental pollution.

DETAILED DESCRIPTION OF A PREFERRED EMBODIMENT

Figure 1:
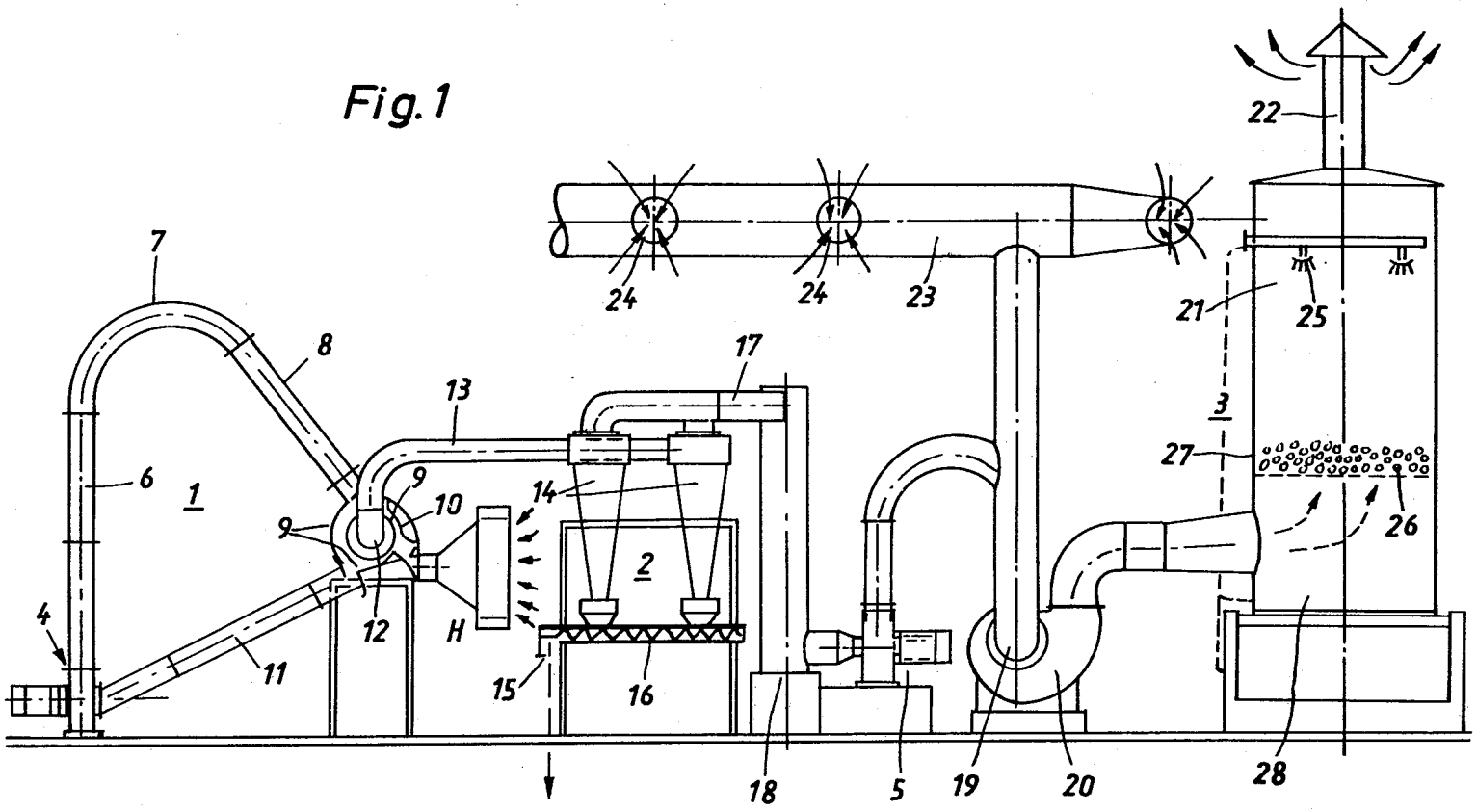
FIG. 1 is a schematic view of the drying and deodorizing system of the present invention.

To further explain the invention, a preferred embodiment of the present invention is illustrated in the drawings wherein FIG. 1 shows a ring-shaped piping system 1, a separator 2 for the separation of the dried substances from the air flow containing odoriferous substances and a sprinkling bed 3 for removing the odoriferous substances from the air flow. The ring-shaped piping system 1 includes a turbulence mechanism 4, which may be, for instance, a hammer mill or a beater mill for whirling and, if necessary, crushing the substances to be dried, a hot air heater H and a blower 5 for providing a suction effect on the piping system 1. A rising tube 6 is arranged above the system inlet at the turbulence mechanism 4 and is connected to a separating device 9 via a wide arcuate elbow 7 and an inclined, essentially straight tube 8. The separating device 9 has adjustable flaps for catching the dried particles and a circular shaped housing 10 which is connected with the turbulence mechanism 4 through an essentially straight tube 11. The turbulence mechanism 4 as well as the entire ring-shaped piping system is hermetically sealed towards the outside. The proper selection of the inclination angle of the tube 8 is essential for obtaining the separating characteristics of the device 9 such that the dried substances can reach the area of the adjustable flaps for discharge and the substances which are still humidified remain in the piping system cycle. The angle that the tubes 8, 11 make in relation to the rising tube 6 amounts to between 10° and 40°.

The hot air heater H has a particular effect on the piping system 1 in the area of the separating device 9 whereby hot air at 280° C to 320° C and, preferably, about 300° C is drawn into the piping system by the suction blower 5. The blower 5 supplies the circulation flow into the circular shaped part 10 and the returning air flow into the tube 11. The separating device 9 has in its center area an opening 12 which is connected to the separator 2 via a tube 13. The tube 13 is connected with one or more funnels, such as cyclone units 14, having at their lower ends a discharge device 15 for the dried substances which have the consistency of flour. The discharge can be performed by means of a screw conveyor 16, either on a continuous basis or dependent on the content of the funnels.

The upper ends of the cyclone units 14 are connected with a common tube 17 to the suction blower 5 operating on the aforedescribed piping system. The cyclone units 14, are provided with rotary cell air locks separating them from the screw conveyor 16 in such a way that no air can be drawn in at the side of the discharge. In other words, this area of the system is also hermetically sealed towards the outside. A dust collection device 18 arranged at the inlet of the suction blower 5 provides for the settling of substances which enter the tube 17. The device 18 is preferably a dust washer using circulating water by means of which the remaining dust particles are removed from the air flow and settled as a mud. The mud collected in this way during the course of operation of the system is removed from time to time and introduced into the turbulence mechanism 4.

The outlet of the suction blower 5 is connected to the suction opening 19 of an additional blower 20 which discharges the humid, odoriferous air flow withdrawn from the piping system 1 and separator 2 to a sprinkling bed 3. The sprinkling bed 3 comprises, for example, a tower 21 filled with limestone 27 and provided with spraying nozzles 25 in the upper portion thereof for spraying water on the air flow discharged into its lower portion. Certain chemicals introduced into the spraying water react with the odoriferous substances to remove the odor from the air flow. The water collected in the lower portion of the tower is recycled, therefore, the water consumption is very low with this arrangement since only make-up water need be added.

Essentially odorless air flow is discharged from the upper end of the tower 21, and in the case of the embodiment described herein, it is discharged through a stack 22 into the atmosphere. The building or enclosure surrounding the almost entirely hermetically sealed piping system is preferably provided with an exhaust air piping system 23 which has openings 24 to induct air from the building. The system 23 is connected to the inlet of the blower 20 by the pipe 19. In the case of systems without an exhaust air piping system, the blowers 5 and 20 could be combined and replaced by a single blower. It is also possible that instead of the suction blower 5 or as a supplement thereto, the air flow could be either totally provided or reinforced, respectively, by a blower forcing the hot air into the hermetically sealed piping system. Such a blower could, for instance, be connected to the exhaust air piping system 23 to force the exhaust air together with the hot air into the piping system 1 while the blower 5 forces the drawn-off air into the sprinkling bed 3.

The turbulence mechanism 4 operates simultaneously as a crushing device for the substances supplied to it and as a unit to throw the crushed, still humid substances up into the piping system. The crushing is at least effected until the crushed substances float in the hot air flow and can overcome the difference in height to the elbow 7. The velocity of the air flow and the piping dimensions are selected in such a way that the crushed substances circulate in the piping system while they are continuously subjected to drying and crushing. All substances with a mass below the value corresponding to the selected velocity are caused to float in the separating system in the area of the opening 12 and are caught by the direct suction effect of the blower 5. The dried substances thereafter settle in the cyclone units 14.

The structure and the operation of the sprinkling bed is adjustable to the accumulated odoriferous substances, e.g. feces, feathers, fish, carcasses, etc. Preferably, a sprinkling bed is used with a suspension of water having dissolved therein powderlike alkaline earth carbonates and sprayed from above through spraying nozzles 25 countercurrently to the air flow admitted to the lower portion of the tower and rising through grids 26 and limestone layer 27, which may also be formed of coke or the like. The water suspension is pumped from the lower collecting tank 28 of the tower 21 by means of a circulating pump (not shown) directly into the spraying nozzles 25 from which the liquid is discharged with a slight overpressure and substantially uniformly distributed over the inner space of the tower 21 so that the air flow containing the odoriferous substances mixes intimately with the sprayed suspension. The irregular limestone layers 27 which may be disposed on one or more grids 26 enhance the uniform distribution of the suspension as well as the intimate mixing of the air flow and the sprayed suspension. If, for instance, an acid-forming gas, such as chlorine, or sulfur dioxide, e.g. in the form of flue gas from boiler firings or the like, is mixed with either the suspension or the air flow, acids will form with the water, for example, in the case of chlorine, hydrochloric acid and hypochlorous acid. The later acid gives off nascent oxygen which destroys the odoriferous substances. The hydrochloric acid reacts with the carbonates and forms chlorides which are taken up by the suspension. The carbonates act thus as an activator by removing the free hydrochloric acid. In the case of sulfur dioxide, the sulfurous acid, to which the odoriferous gases are bound as acid salts, are transformed into lime salts with the calcium carbonate which are odorless and remain in the suspension.

Figure 2:
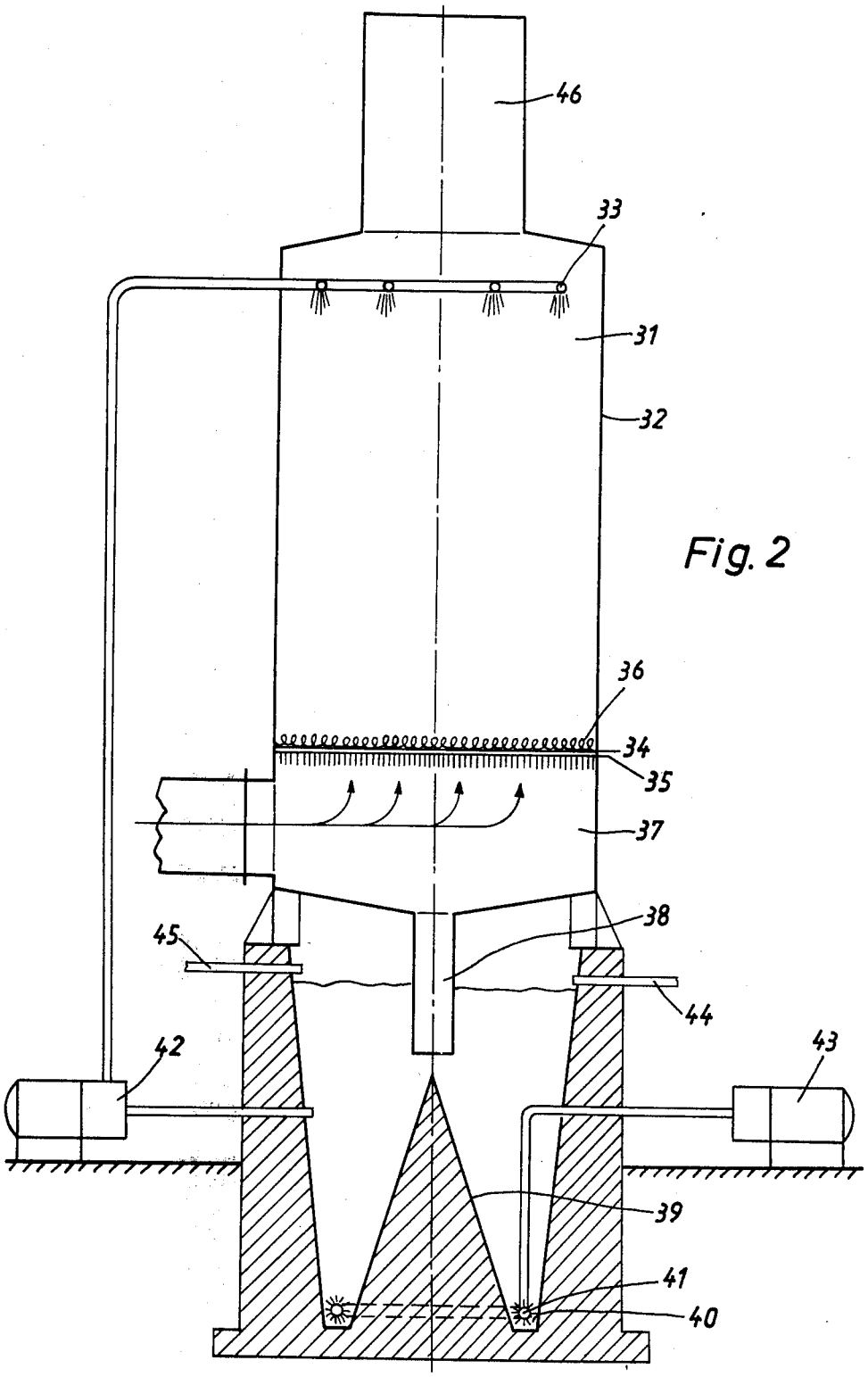
FIG. 2 is a schematic view of one embodiment of the deodorization tower of the present invention.

FIG. 2 shows another embodimment of the tower 21 illustrated in FIG. 1 and comprises a tower 31 having a jacket 32 and, arranged at the upper portion of the tower, a spraying device in the form of a shower ring 33 for spraying the water suspension. In the lower part of the tower, there is a turbulence stage 34 which includes a grid 35 having arranged thereon a loose layer 36 of lumpy alkaline earth carbonate and is more fully described hereinbelow.

Instead of the alkaline earth compounds, i.e. calcium and/or magnesium carbonate layers, one or more layers of coke or one or more layers of simple stones may be used without causing any significant disadvantages to the process. This arrangement causes the layers to whirl up or agitate the rising released gas flow mixed with chlorine or $SO_2$ so that the sprayed suspension can react more intensely with such gas flow. For this reason, the grid 35 and layer 36 were previously described as a turbulence stage. To reduce costs and also for technical reasons, stone layers are preferably utilized because the danger of clogging due to lime deposits is minimized. Theoretically, a screen would have the same effect, however, after a certan period of operation, the danger of clogging of the individual openings would develop whereby the uniform whirling effect of the entire surface would become questionable.

The particle size of the layer 36 can range from about 30 to 300 mm, with particularly good results obtained with particles ranging from about 50 to 150 mm. The height of the tower may be from 1 to 9 m, especially from 2 to 7 m, and preferably from 5.5 to 6.5 m. The depth of layer 36 may range from 50 cm to 1 m. The particle size and the relation of the height of the individual towers or cleaning units, respectively, to the diameter thereof and also to the height of the layer 36 of the turbulence stage, are interdependent and can be computed on the basis of the given reaction periods. They can be varied at random within the constructive limits that can be justified. The reaction period itself is dependent on the velocity of the rising released gas flow in the tower. Here, a rising velocity of from 0.5 to 1.5 meters per second must be maintained. Therefore, if, for instance, a greater amount of released gas is supplied through the tower with the same height of the tower, i.e. also at the same reaction period, only the tower diameter must be correspondingly enlarged.

The released gases to be deodorized are supplied into an ante-room 37 of the tower 31 below the turbulence stage 34 as a mixture with chlorine gas introduced by means of a fan or a pump (not shown). In the ante-room 37 the gases contact the suspension wetting the stones or the wetted stones and are thus subjected to a first cleaning, the effect of which is known. The suspension discharged from the turbulence stage 34 in droplets from the grid 35, is collected, processed and returned with the necessary activation for a renewed spraying. Thus, a re-mixing zone is provided for the suspension which, for reasons of expediency, is arranged directly at the lower part of the tower. As is known, the suspension is partially separated when passing through the tower from the top to the bottom. If no re-mixing zone is provided, lime deposits would develop at the bottom of the tower. Such lime deposits could interfere with the return action of the suspension to the individual shower rings 33. Therefore, care must be taken that the separating effect which develops during the spraying of the suspension in the tower 31 is eliminated before the suspension is again pumped upward to the shower rings 33 for renewed circulation.

Figure 3:
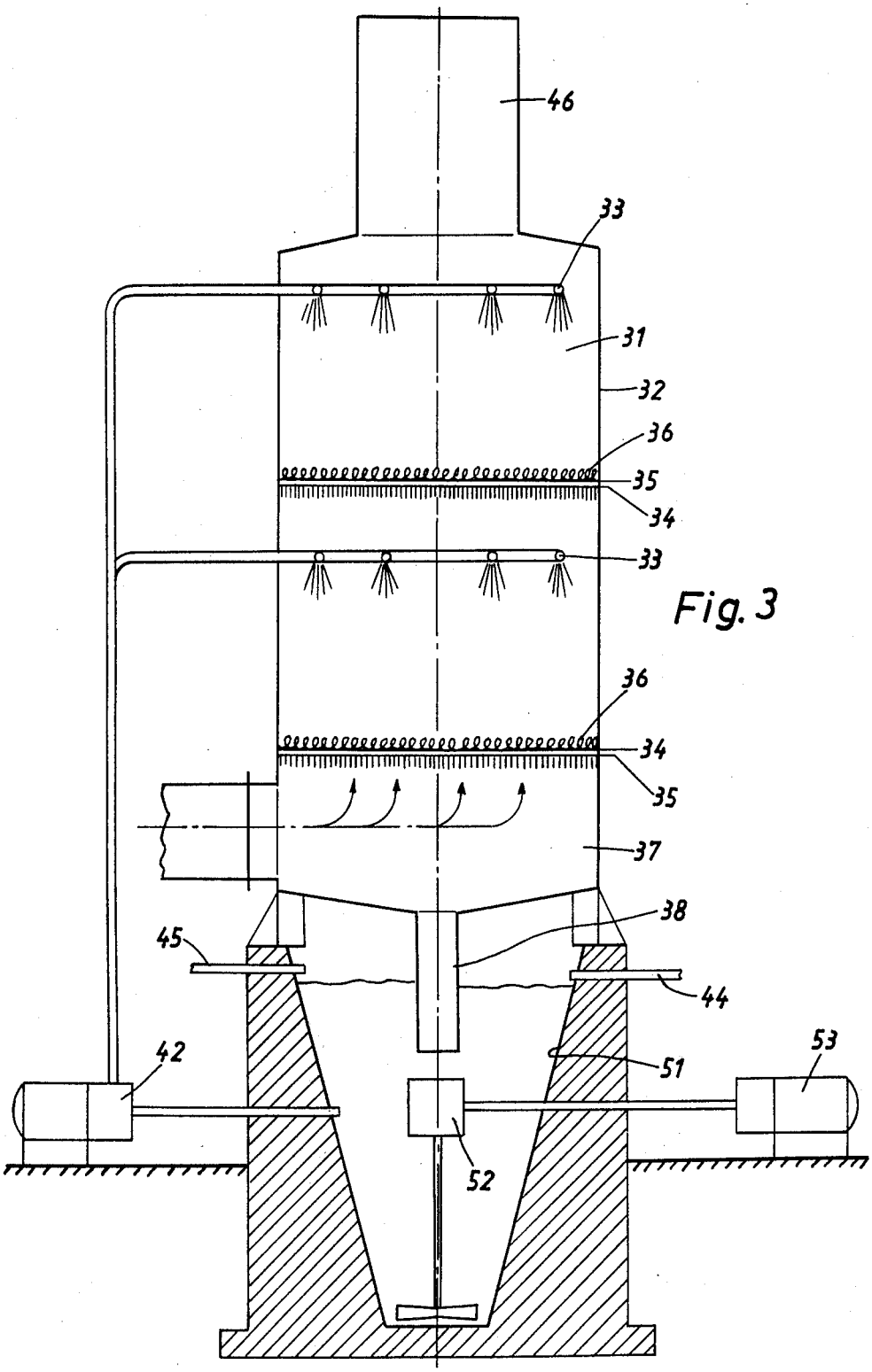
FIG. 3 is a schematic view of another embodiment of the deodorization tower of the invention.

Two different methods are, for instance, available for performing the renewed circulation. In FIG. 2, for example, the task of a renewed mixing of the suspension is accomplished by providing a cone 39 arranged below the drain 38 whereby the point of the cone 39 coincides with the axis of the tower 31 and drain 38. Thus, an annular channel 40 is formed about the base of the tower in which channel, lower nozzles 41 are arranged for supplying air or water pressure from a source, such as, for example, air compressor 43, the function of which is to uniformly mix the partially separated suspension. The angle of the cone is preferably from 20° to 60°. If the angle exceeds 60°, a heavy lime deposit will occur on the cone surfaces so that the desired purpose cannot be achieved. An overflow 44 is provided through which a part of the suspension is continuously drawn off and pumped to the top of the tower 31 by means of a circulating pump 42 for recirculation through the system. There is also a feeding conduit 45 through which new i.e. fresh suspension or make-up water is supplied according to the existing requirements. The second method of performing the renewed circulation is illustrated in FIG. 3 and is described in further detail hereinbelow. FIG. 3 illustrates another embodiment of the invention whereby two turbulence units are arranged in superposed relation. In this instance, a lower spraying ring 33 and turbulence stage 34 are provided below the upper turbulence stage 34. Thus, the suspension is also sprayed through a spraying device 33 into the empty parts of the second turbulence stage 34. The suspension coming from the upper part of the tower passes through the upper turbulence stage 34 in droplets or flows down the wall of the tower as a continuous film and wets the lower turbulence stage 34. There can, of course, be arranged more than two superposed units, i.e. three or four, however, in such cases, attention must be given to the thickness of the layer of the carbonate which must be maintained smaller so as to avoid a greater and therefore uneconomical pumping requirement. As an example, instead of a 1 meter thickness of the layer in the case of the single unit, it is expedient to only use a 50 cm thickness for the calcium carbonate layer in the case of the double unit. It will also be clear to one skilled in the art that he should select the particle size in the upper range in the case of multiple units in order to keep the pressure loss as low as possible.

The suspension accumulating in the lower part of the tower and passing through the drain 38 reaches the re-mixing zone for renewed circulation. A funnel or conical cavity 51 is provided in the re-mixing zone which is equipped with an agitator 52 driven by a drive motor 53. The suspension thus mixed is then circulated as aforedescribed to the two spraying rings 33 by means of the circulating pump 42. The overflow 44 (FIGS. 2 and 3) can be connected to one or more re-settling tanks (not shown) where the excessive suspension is delivered for settling the solid particles containing alkaline earth chlorides as well as the carbonates which were not transformed. The clarified water can then be withdrawn without causing environmental problems. These overflow tanks operate in accordance with known separation principles. Deodorized gases are removed from the tower 31 of the embodiments of both FIGS. 2 and 3 through a stack 46.

The advantages of the present invention wherein a cleaning tower for released gases with one or several air turbulence stages constitutes vis-a-vis a tower for released gases being essentially filled with limestone can be summarized as follows:

1. A reduction of the air resistance in the tower from 280 mm water column to 50 mm water column is effected with a simultaneous improvement of the released gas cleaning process itself.

2. The size of the structure of the tower can be considerably reduced because, by using a calcium or magnesium carbonate suspension instead of lumpy calcium or magnesium carbonate, the volume of a tower for a released gas flow of, for instance, 30,000 cubic meters per hour which is once supplied through a filled tower and once through a tower operating with a suspension, is reduced by 70 percent.

3. The weight of the tower is reduced by 80 percent. If the comparison example is based on a system with two towers, each with a capacity of 30,000 cubic meters of air per hour, a tower filled with limestones in accordance with present constructions has an operating weight of 60 tons. A tower having the same capacity which operates in accordance with the suspension principle by means of turbulence stages has an operating weight of only 12 tons.

4. A tower with a capacity of 30,000 cubic meters per hour filled with limestones in the conventional way has a power consumption with regard to the blower output for the quantity of released gas of 37 kilowatt hours. A tower having the same capacity which operates in accordance with the suspension principle in connection with air turbulence stages has an energy consumption of only 11 kilowatt hours for the blower. Thus, the energy requirement is reduced by 70 percent.

From the foregoing it will be completely clear that the present invention offers significant advantages and improvements over conventional systems. Although only preferred embodiments of the present apparatus and method are specifically illustrated and described herein, it will be appreciated that many modifications and variations of the present invention are possible in light of the above teachings and within the purview of the appended claims without departing from the spirit and intended scope of the invention.

What is claimed:

1. A method of processing malodorous animal and vegetable wastes, such as feces feathers, hair, remains fronm slaughtering, carcasses and the like comprising the steps of introducing the malodorous wastes into a ring-shaped piping system having a turbulence mechanism, circulating air flow through the piping system for drying the malodorous wastes, directing the air flow discharged from the ring-shaped piping system and containing the dried wastes to a separating device, separating the air flow from the dried wastes, reacting the air flow with a sprinkling bed for a period of from about 1 to 9 seconds to remove substantially all the odor from the air flow and discharging to atmosphere the essentially odorless air flow from the sprinkling bed.

2. The method in accordance with claim 1 wherein the step of circulating air flow through the piping system includes providing a hot air flow to the piping system.

3. The method in accordance with claim 1 wherein a reaction period of from about 2 to 7 seconds is maintained.

4. The method in accordance with claim 1 wherein a reaction period of from about 5.5 to 6.5 seconds is maintained.

5. The method in accordance with claim 1 wherein the air flow is circulated such that the flow through the sprinkling bed rises with a velocity of from about 0.5 to 1.5 meters per second.

6. The method in accordance with claim 1 including the step of reacting the air flow with a calcium and/or magnesium carbonate solution as an alkaline earth carbonate solution.

7. The method in accordance with claim 1 including the step of reacting the air flow with a suspension of from about 5 to 30 parts water to one part calcium and/or magnesium carbonate.

8. The method in accordance with claim 1 including the step of deodorizing the air flow by mixing an acid-forming gas with the air flow reacting with the sprinkling bed.

9. The method in accordance with claim 8 wherein said acid-forming gas is chlorine.

10. The method in accordance with claim 8 wherein said acid-forming gas is sulfur dioxide.

11. The method in accordance with claim 6 including the step of mixing the alkaline earth carbonate solution with an acid-forming gas.

12. The method in accordance with claim 1 including the step of inducing the circulating air flow into the piping system from the space surrounding the piping system.

13. The method in accordance with claim 1 including the step of crushing the malodorous wastes in the turbulence mechanism.

14. The method in accordance with claim 1 wherein the reacting step includes the steps of spraying an alkaline earth carbonate solution in countercurrent flow relation to the air flow in a sprinkling bed tower, collecting the solution in the lower portion of the sprinkling bed tower, uniformly mixing the collected solution, recycling the uniformly mixed solution through the sprinkling bed tower and including the step of deodorizing the air flow by introducing an acid-forming gas into the sprinkling bed tower.

15. An apparatus for drying odoriferous organic substances comprising a piping system including a turbulence mechanism having a rising tube connected thereto, means connecting the rising tube with a separating device operating on a centrifugal basis, a first tube connected to the separating device for collecting the unseparated, suspended substances and transferring said substances back to the turbulence mechanism, the separating device having a central opening for collecting the separated substances, a second tube connecting the opening to a suction blower, said suction blower generating an air flow, said second tube being arranged above the funnels of cyclone units and having openings arranged in such a way that the substances suspended in the air flow settle into the funnels, a dust washer provided at the inlet of the suction blower, and a tower having a sprinkling bed, the outlet of said suction blower being connected to said tower in such a way that the odoriferous air is forced into the tower.

16. Apparatus in accordance with claim 15 including an additional blower having an outlet connected to the tower and wherein the outlet of the suction blower is connected to the inlet of said additional blower.

17. Apparatus in accordance with claim 16 including an exhaust air piping system which draws off the exhaust air from the space around the piping system and wherein the inlet of the additional blower is connected to said exhaust air piping system.

18. Apparatus in accordance with claim 15 including another blower which produces or reinforces the system air flow by forcing hot air into the piping system.

19. Apparatus in accordance with claim 18 including an exhaust air piping system and wherein the suction opening of said another blower is connected to said exhaust air piping system.

20. Apparatus for the deodorization of released gases in accordance with claim 15 wherein said tower comprises a jacket having at the upper portion thereof a suspension spraying system and a turbulence stage and at a lower portion thereof means for introducing the released gases mixed with chlorine, one or more turbulence stages being provided whereby a spraying system is arranged with a respective turbulence stage and a re-mixing zone arranged at the lower part of the tower.

21. Apparatus in accordance with claim 20 including a drain in the bottom of the tower and a cone mounted in the re-mixing zone below the drain, the apex of said cone being aligned with the axis of the tower and drain, a channel surrounding the cone and pressure nozzles arranged in the channel for mixing the suspension.

22. Apparatus in accordance with claim 20 including a drain in the bottom of the tower, a conical cavity arranged below the drain and an agitator mounted in said cavity for mixing the suspension.

23. Apparatus in accordance with claim 20 including an overflow and a feeding conduit provided in communication with the re-mixing zone.

24. Apparatus in accordance with claim 23 wherein one or more settling tanks are connected downstream of the overflow.

25. Apparatus in accordance with claim 20 wherein the turbulence stage includes a grid having arranged thereon a loose layer of particulate matter.

26. Apparatus in accordance with claim 25 wherein said particulate matter is an alkaline earth carbonate.

27. Apparatus in accordance with claim 20 including means for introducing an acid-forming gas into the tower.

28. Apparatus according to claim 8 wherein said means connecting the rising tube with the separating device includes an inclined tube and wherein the angle each of the said inclined tube and the said first tube makes with the rising tube is from about 10° to 40°.

* * * * *

UNITED STATES PATENT AND TRADEMARK OFFICE

CERTIFICATE OF CORRECTION

PATENT NO. : 3,991,480

DATED : November 16, 1976

INVENTOR(S) : WILHELM MENGE

It is certified that error appears in the above-identified patent and that said Letters Patent are hereby corrected as shown below:

Column 1, line 7, after "odoriferous" insert --organic--;

Column 6, line 51, "FIG. 3 illustrates another" should begin a new paragraph;

Claim 1, line 3, change "fronm" to --from--;

Claim 28, line 1, change "claim 8" to --claim 15--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*